United States Patent [19]

Usutani et al.

[11] Patent Number: 4,899,718

[45] Date of Patent: Feb. 13, 1990

[54] APPARATUS FOR TRUING GRINDING WHEEL

[75] Inventors: Shigenobu Usutani, Nishio; Toshio Maruyama; Tadashi Yamauchi, both of Kariya; Yasunori Ban, Hashima, all of Japan

[73] Assignee: Toyoda Koki Kabushiki Kaisha, Kariya, Japan

[21] Appl. No.: 260,782

[22] Filed: Oct. 21, 1988

[30] Foreign Application Priority Data

Oct. 22, 1987 [JP] Japan ..... 62-267519

[51] Int. Cl.[4] ..... B24B 53/08

[52] U.S. Cl. ..... 125/11 TP; 125/11 CD; 51/165.77; 51/165.88

[58] Field of Search ..... 51/5 D, 165 R, 165.71, 51/165.77, 165.87, 165.88, 325; 125/11 TP, 11 PH, 11 CD, 11 NT

[56] References Cited

U.S. PATENT DOCUMENTS

| | | | |
|---|---|---|---|
| 2,838,040 | 6/1958 | Balsiger et al. | 125/11 PH |
| 3,798,845 | 3/1974 | Stevens | 51/165.87 |
| 3,841,296 | 10/1974 | Ota | 125/11 PH |
| 4,160,438 | 7/1979 | Fujita | 125/11 TP |
| 4,266,374 | 5/1981 | Asano et al. | 51/165.87 |
| 4,274,231 | 6/1981 | Verega | 125/11 PH X |
| 4,391,066 | 7/1983 | Munekata et al. | 51/165.87 |
| 4,551,950 | 11/1985 | Unno et al. | 51/165.87 |
| 4,571,892 | 2/1986 | Brill | 51/325 |
| 4,831,785 | 5/1989 | Sigg | 51/165.77 X |

*Primary Examiner*—Robert P. Olszewski

*Attorney, Agent, or Firm*—Oblon, Spivak, McClelland, Maier & Neustadt

[57] ABSTRACT

A truing apparatus for an angle grinding wheel with two grinding surfaces is provided with an AE sensor for detecting the contact of a truing tool with each of the grinding surfaces. The truing tool is provided on a follow slide which is mounted on a traverse slide. As the traverse slide is moved in a first direction, the follow slide is moved following a template in a second direction extending across the first direction. In response to a truing command, at each of first and second traverse positions in the first direction, the truing tool is advanced relative to the follow slide until a contact signal is issued from the AE sensor upon contact of the truing tool with a corresponding one of first and second grinding surfaces. A position sensor detects first and second feed positions at which the truing tool contacts the two grinding surfaces. One of the feed positions which is shorter in distance from the follow slide is selected to determine a truing start position. The truing tool is then moved to the truing start position and is traversed in the first direction while following the template in the second direction. It is ascertained whether the AE sensor continues to issue the contact signal during each traverse movement of the truing tool. The infeed movement and traverse feed movement of the truing tool are repeated until the continuous issuance of the contact signal during each traverse movement of the truing tool is confirmed.

6 Claims, 4 Drawing Sheets

APPARATUS FOR TRUING GRINDING WHEEL

BACKGROUND OF THE INVENTION

1. Field of the Invention

The present invention relates in general to an apparatus for truing a grinding wheel by moving a truing tool following a template and more particularly, to such a truing apparatus designed for truing, preferably, an angle grinding wheel which has two grinding surfaces.

2. Discussion of the Prior Art

In a prior art truing apparatus for angle grinding wheels, a traverse slide is movable in a direction which is approximately parallel to the rotational axis of an angle grinding wheel. A follow slide is guided on the traverse slide for sliding movement in a direction perpendicular to the rotational axis of the grinding wheel, and a truing tool provided on the follow slide is movable by a drive device in the same direction as the sliding movement of the follow slide. As the traverse slide is moved, the follow slide is advanced and retracted toward and away from the grinding wheel, following the template, so that the grinding wheel is trued to have the same profile at its grinding surface as the template.

However, the grinding wheel has to be replaced with a new or fresh one when its diameter is reduced beyond a limited size. When the fresh grinding wheel is attached to the grinding machine, it is often the case that a corner or top edge at which first and second grinding surfaces are conjunctive is not precisely aligned with a corresponding top edge of the template in the sliding direction of the follow slide. It is also often the case that the dimension of the fresh grinding wheel does not precisely coincide with that at the first use of the old one. Thus, if an automatic truing operation were performed right after the fresh grinding wheel is attached to the grinding machine, it would necessarily result that a long truing time is taken because a safety margin in truing operation has to be sufficiently secured to avoid damages on the grinding wheel as well as on the truing tool.

To avoid this inconvenience, in the prior art truing apparatus, an operator has to intervene in truing a fresh grinding wheel at the very first time on the grinding machine. That is, in that event, manual adjustments of the truing apparatus are performed to approach the truing tool to the grinding wheel surface and then to traverse the truing tool over the grinding wheel surface. The truing operation under the operator's observation is completed when the truing of a uniform infeed depth over the entire width of the grinding surface is confirmed by listening to the tool-wheel engagement sound.

Moreover, in the case of such an angle grinding wheel, uneven abrasion or wear often occurs at the two grinding surfaces. In a viewpoint of effective use of the grinding wheel, it is desirable that the truing infeed depth against the grinding wheel be sufficient to revive the grinding capability of the wheel but as small as possible. Accordingly, it is also required that a desired infeed depth against the grinding wheel be given precisely.

SUMMARY OF THE INVENTION

Accordingly, it is a primary object of the present invention to provide an improved truing apparatus which does not require any human intervention in truing a fresh grinding wheel at the very first time on a grinding machine.

Another object of the present invention is to provide an improved truing apparatus of the character set forth above in which the truing operation in a full automatic mode can be performed right after a fresh grinding wheel is attached to a grinding machine.

A further object of the present invention is to provide an improved truing apparatus of the character set forth above which is particularly designed for an angle grinding wheel with first and second grinding surfaces extending at a given angle relative to each other.

A still further object of the present invention is to provide an improved truing apparatus of the character set forth above which is capable of precisely infeeding a truing tool against a grinding wheel notwithstanding the fact that the grinding works cause a difference in abrasion between first and second grinding surfaces of the grinding wheel.

An yet further object of the present invention is to provide an improved truing apparatus wherein one of first and second grinding surfaces which has less abrasion is taken as a reference surface to give the infeed of a desired depth therefrom against the grinding wheel.

Briefly, in a truing apparatus according to the present invention, on a traverse slide movable in a first direction, there is mounted a follow slide which is movable following a template in a second direction across the first direction. A truing tool is carried on the follow slide so as to be movable in the second direction. A contact sensor is provided to issue a contact signal when the truing tool is in contact with a grinding wheel. At first and second traverse positions spaced in the first direction, the truing tool is moved toward the grinding wheel until the contact signal is issued from the contact sensor. A position sensor is provided to detect first and second feed positions to which the truing tool is advanced respectively at the first and second traverse positions. One of the first and second feed positions which is shorter in distance relative to the follow slide than the other feed position is selected to determine a truing start position. Then, the truing tool is positioned to the truing start position and is traversed along the grinding wheel surface while following the template. Ascertainment is made as to whether the contact signal from the contact sensor is continued to issue during the traverse feed movement. If the continuous issuance of the contact signal is not ascertained, then the truing tool is infeed a predetermined amount against the grinding wheel surface before it is traversed again along the wheel surface. The infeed and the traverse feed of the truing tool is repeated until the continuous issuance of the contact signal during each traverse feed movement is finally ascertained.

With this configuration, two positions at the grinding wheel surface relative to the follow slide are precisely located prior to the actual truing operation, and in the actual truing operation, the infeed and traverse feed are repeated until the uniform truing over the entire width of the grinding wheel surface is ascertained by the contact signal from the contact sensor. Consequently, prior to the actual truing operation, the truing tool can be precisely positioned without an excessive infeed against the grinding wheel and as close thereto as possible, and the actual truing operation can be terminated when the grinding wheel is uniformly trued. This not only results in the realization of the full-automatic truing of a fresh grinding wheel at the very first time right after the attachment of the fresh grinding wheel to a grinding machine, but also results in the effective use of the grinding wheel because a desired truing infeed is given from one of the precisely located positions.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiment when considered in connection with the accompanying drawings, wherein like reference numerals designate identical or corresponding parts throughout the several views and in which.

Figure 1:
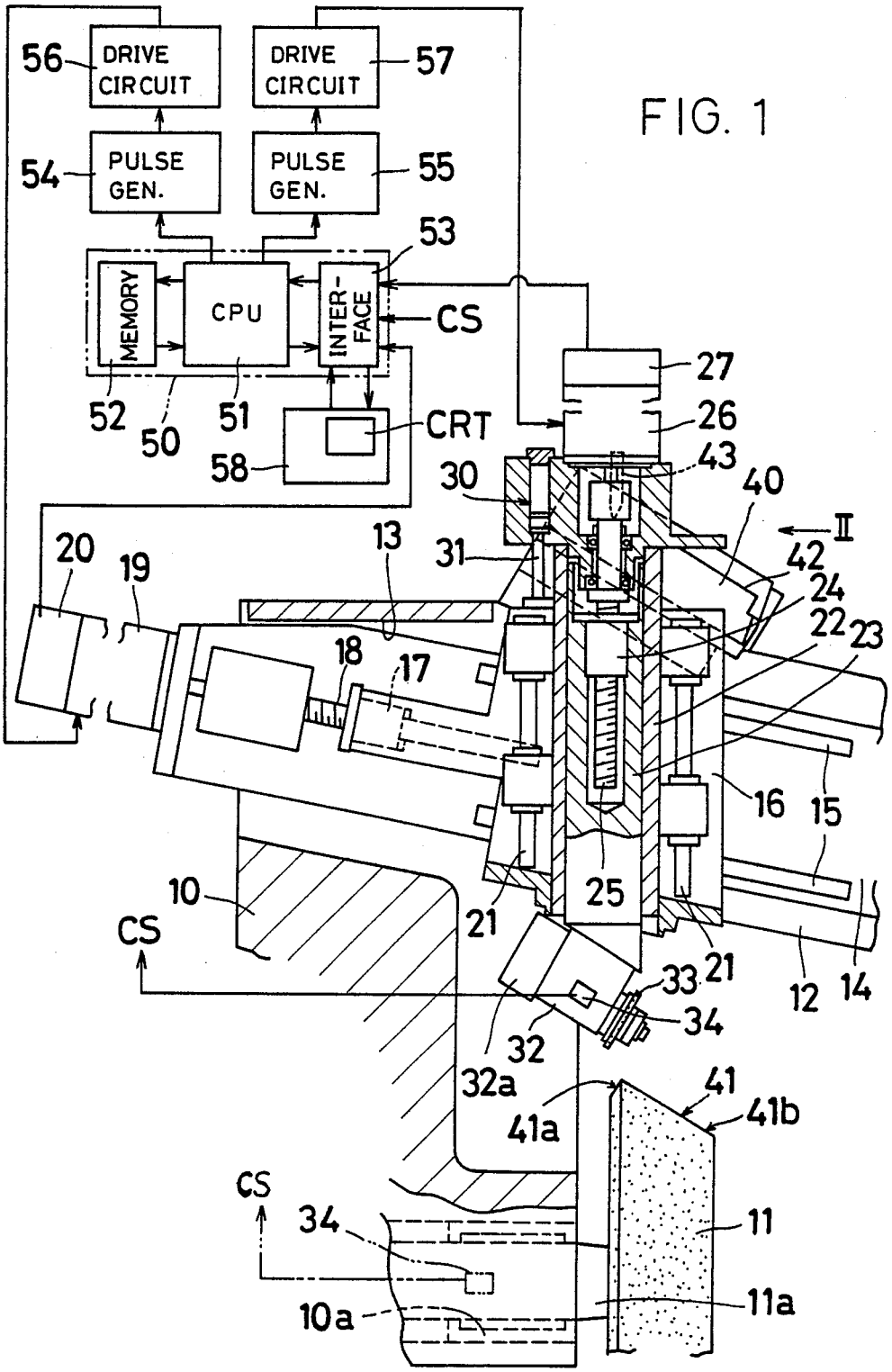
FIG. 1 is a plan view, partly in section, of a truing apparatus to the present invention.
Figure 4:
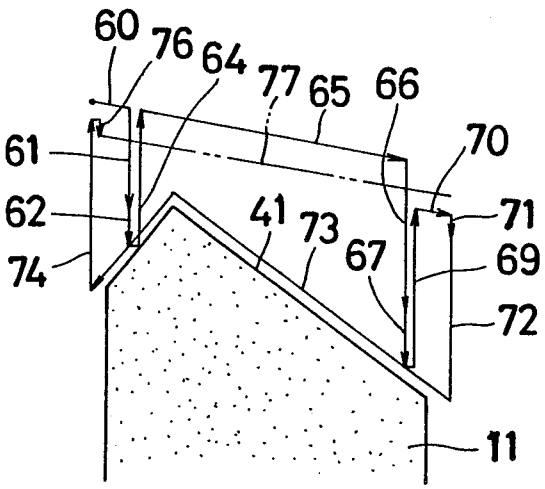
Figure 3A:
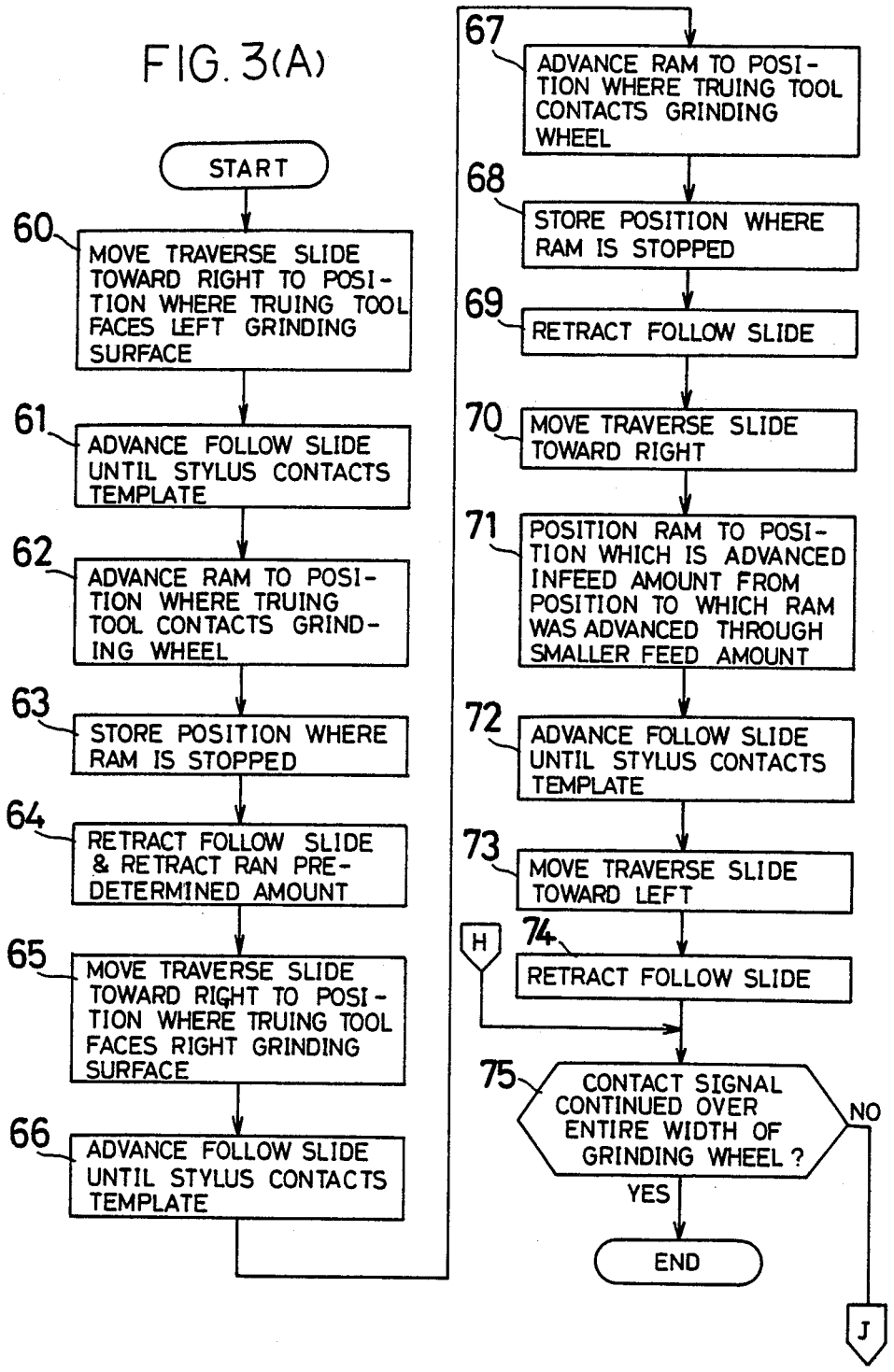
Figure 3B:
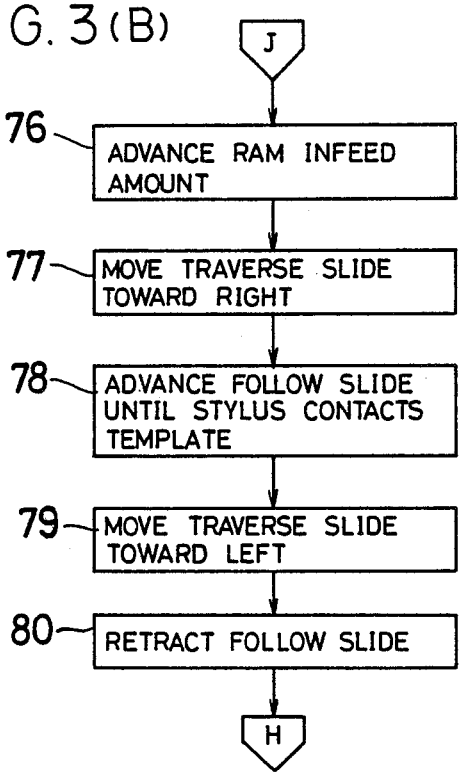

FIGS. 3(A) and 3(B) are flow charts of a truing control program executed by a numerical controller shown in FIG. 1; and FIG. 4 an explanatory view illustrating the operational steps of a truing tool.

DETAILED DESCRIPTION OF THE PREFERRED EMBODIMENT

Referring now to the drawings and particularly to FIG. 1 thereof, an angle slide grinding machine is shown having a wheel head 10, which rotatably carries an angle grinding wheel 11 through a wheel spindle 11*a*. The wheel head 10 has attached to a rear lateral surface thereof a support bracket 12, on which a truing base 14 is fixedly mounted to extend a left end portion thereof into a space 13 formed in the wheel head 10. A pair of first guide ways 15 which extends in a direction slanted relative to the rotational axis of she grinding wheel 11 are formed on the truing base 14. A traverse slide 16 is mounted on the truing base 14 for sliding movement along the first guide ways 15. The traverse slide 16 is fixedly provided with a nut 17, which is in threaded engagement with a ball screw 18. One end of the ball screw 18 is drivingly connected with an output shaft of a servomotor 19 attached to the truing base 14. The servomotor 19 is provided with an encoder 20 (position sensor) for detecting the rotational amount of the ball screw 18.

The traverse slide 16 is formed with another pair of second guide ways 21 which extend in a direction perpendicular to the rotational axis of the grinding wheel 11. A follow slide 22 is carried to be slidable along the second guide ways 21. A ram 23 is carried in the follow slide 22 for sliding movement in a direction perpendicular to the rotational axis of the grinding wheel 11. The ram 23 has attached thereto a nut 24 threadedly engaged with a ball screw 25, one end of which is drivingly connected to an output shaft of a servomotor 26 attached to the follow slide 22. The servomotor 26 is provided with an encoder 27 for detecting the rotational amount of the ball screw 25. The follow slide 27 is formed therein with a hydraulic cylinder 30, whose piston rod 31 is connected to the traverse slide 16 for moving the follow slide 22 along the guide ways 21.

To a front end of the ram 23, there is attached a truing head 32, on which a truing tool or roll 33 is carried to be rotatable about an axis parallel to a right grinding surface 41*b* of the wheel 11. The truing head 32 has secured thereon an acoustic emission (AE) sensor 34, a kind of vibration sensors. The AE sensor 34 converts the tool-wheel contact sound into a corresponding electric signal and outputs an ON-signal when the converted electric signal exceeds a predetermined signal level. A truing roll drive motor 32*a* is also attached to the truing head 32 for rotationally driving the truing roll 33.

Figure 2:
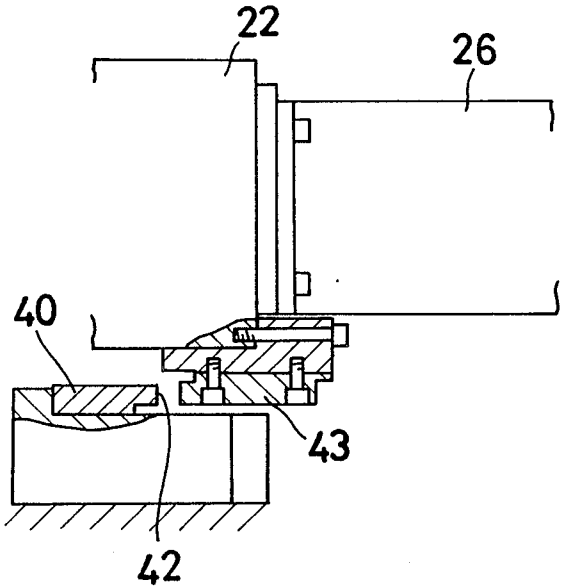
FIG. 2 is a fragmentary side view of the apparatus as viewed from the direction indicated by the arrow II in FIG. 1.

A template 40 is fixed on a truing base 14, as shown also in FIG. 2. The template 40 has a stylus guide surface 42 which coincides in profile with the grinding surface 41 of the grinding wheel 11. A stylus 43 is attached to the follow slide 22 for contact with the stylus guide surface 42. The hydraulic cylinder 30 operates to bring the stylus 43 into contact with the stylus guide surface 42.

A reference numeral 50 denotes a numerical controller for controlling the truing apparatus as constructed above. The numerical controller 50 is primarily composed of a CPU (central processing unit), a memory 52 and an interface circuit 53. The CPU 51 is connected to the servomotors 19, 26 through pulse generation circuits 54, 55 and motor drive circuits 56, 57. The interface circuit 53 is connected to an operator's panel 58 with a CRT unit, the encoders 20, 27 and the AE sensor 34. Also connected to the interface circuit 53 is a well-known sequence controller (not shown), which operates to control the hydraulic cylinder 30 and the truing roll drive motor 32*a*. The panel 58 enables an operator to define a traverse area within which a contact signal from the AE sensor 34 is made effective, taking the width of the grinding wheel 11 into consideration. The panel 58 further enables him to define two positions of the traverse slide 16 at which the truing roll 33 is to be brought into contact with left and right grinding surfaces 41*a* and 41*b* of the wheel 11.

The memory 52 has stored therein a truing infeed amount of the truing roll 33 and a truing control program shown in the form of flow charts in FIGS. 3(A) and 3(B). Briefly, the control program is composed of steps 60–70 for a locating operation, steps 63 and 68 for a position memory operation, a step 71 for a truing start position setting operation, steps 72–74 for an actual truing operation, a step 75 for a judgment operation, and steps 76–80 for a re-truing operation.

The truing operation of the apparatus as constructed above will now be described with reference to FIGS. 3(A), 3(B) and 4. Let it be now assumed that the truing apparatus is in the original state of position wherein the traverse slide 16 is at the left end of its traverse movement and wherein the follow slide 22 and the ram 23 have been sufficiently retracted, as shown in FIG. 1. In this original state, when a truing command is given, the traverse slide 16 is moved rightwards to a first traverse position where the truing roll 33 faces the left grinding surface 41*a*. (step 60) The first traverse position has been defined by the operator in advance, as mentioned earlier. Then, the follow slide 22 is advanced by the hydraulic cylinder 30 until the stylus 43 comes into contact with the template 40. (step 61) The ram 23 is advanced with the truing roll 33 and the grinding wheel 11 both rotating, and the advance movement of the ram 23 is discontinued when the contact of the truing roll 33 with the grinding wheel 11 is detected by the AE sensor 34. (step 62). The position of the ram 23 now stopped is detected by the encoder 27 to be stored in the memory 52. (step 63)

The follow slide 22 is retracted by the hydraulic cylinder 30 and the ram 23 is retracted a predetermined amount. (step 64) Thereafter, the traverse slide 16 is moved rightwards to a second traverse position which has been defined in advance, so that the truing roll 33 faces the right grinding surface 41*b* of the wheel 11. (step 65) The follow slide 22 is again advanced until the stylus 43 comes into contact with the template 40. (step 66) The ram 23 is then advanced with the truing roll 33 and the grinding wheel 11 both rotating, and the advance movement of the ram 23 is discontinued when the contact of the truing roll 33 with the grinding wheel 11 is detected by the AE sensor 34. (step 67) The position of the ram 23 so stopped is detected by the encoder 27 to be stored in the memory 52. (step 68) The follow slide 22 is retracted by the hydraulic cylinder 30, whereafter the traverse slide 16 is moved to the right end of the traverse movement. (steps 69 and 70) Then, a comparison is effected between the first and second positions of the ram 23 where the truing roll 33 contacted the left and right grinding surfaces 41*a* and 41*b*. In this case, if the first stored position of the ram 23 at the first traverse position is shorter in distance relative to the follow slide 22 than the second stored position of the ram 23 at the second traverse position, the first stored position is selected to determine a truing start position prior to the actual truing operation. Conversely, if the second stored position of the ram 23 at the second traverse position is shorter in distance relative to the follow slide 22 than the first stored position at the first traverse position, the second stored position is selected to determine the truing start position prior to the actual truing operation. That is, after the traverse slide 16 reaches the right end of its traverse movement, the ram 23 is further advanced relative to the follow slide 22 by a predetermined truing infeed amount beyond the selected one of the first and second stored positions and the follow slide 22 is advanced by the hydraulic cylinder 30. (step 72) Thus, the truing roll 33 is positioned to the truing start position.

The traverse slide 16 is moved toward the left end of its traverse movement. (step 73) During this traverse movement, the follow slide 22 and the ram 23 are bodily moved following the template 40, whereby the grinding wheel 11 is trued. When the left stroke end of the traverse slide 16 is reached, the follow slide 22 is retracted by the hydraulic cylinder 30. (step 74) After the retraction of the follow slide 22, it is ascertained whether the contact signal which exceeds the predetermined level, that is, the ON-signal was continued to issue from the AE sensor 34 while the truing roll 33 was moved over the set traverse area. (step 75). If the continuous issuance of the ON-signal over the set traverse area is ascertained, the control program reaches its program end step to complete the truing operation. If the continuous issuance is not ascertained, the ram 23 is infeed by the predetermined amount again, and the traverse slide 16 is moved to the right stroke end. The hollow slide 22 is then advanced, and the traverse slide 16 is moved toward left. As a result, the ram 23 is advanced and retracted following the template 40 so as to perform another truing operation. (steps 78 and 79) Subsequently, the hollow slide 22 is retracted again. (step 80) Ascertainment is made again as to whether the ON-signal from the AE sensor 34 was continued during the traverse feed of the truing roll 33 throughout the set traverse area. (step 75) If the ON-signal was continued, the program is ended. However, if it was not continued, the operations at steps 76–80 are repeated.

In this manner, the first and second positions at the grinding surfaces 41*a*, 41*b* relative to the follow slide 22 are located prior to the actual truing operation, and one of the first and second positions which is shorter in distance relative to the follow slide 22 is selected to determine the truing start position. Thus, the truing roll 33 can be accurately infeed by a desired amount against grinding wheel 11 even in the existence of a difference in abrasion between the first and second grinding surfaces 41*a*, 41*b*, so that the effective use of the grinding wheel 11 can be realized. More importantly, the truing operation is automatically completed when it is ascertained that the grinding surfaces 41*a*, 41*b* are trued over the entire widths thereof. Thus, it becomes possible to automatically true a fresh grinding wheel at the very first time right after the same is attached to the grinding machine.

In accordance with the truing control program, the ascertainment (step 75) is performed after the retraction (step 74 or 80) of the follow slide 22. However, it may otherwise be possible to make the ascertainment before the retraction (step 74 or 80) of the follow slide 22. Further, in addition to the truing of an angle grinding wheel, the present invention may be applied to the truing of a step grinding wheel having two grinding surfaces of different diameters. In this case, the contact signal CS which the AE sensor 34 issues while the truing roll 33 trues a shoulder surface portion between the two grinding surfaces is disregarded.

Although the AE sensor 34 is attached to the truing head 32 in the aforementioned embodiment, it may be more advantageous to attach, the AE sensor 34, as shown by the phantom line in FIG. 1, to the wheel head 10 where a hydrostatic bearing 10*a* is incorporated in the wheel head 10 to rotatably carry the wheel spindle 11, because the contact signal CS from the AE sensor 34 can be more easily transmitted through such a hydrostatic bearing 10*a* than through an antifriction bearing as used to carry the truing roll 33.

Obviously, numerous modifications and variations of the present invention are possible in light of the above teachings. It is therefore to be understood that within the scope of the appended claims, the present invention may be practiced otherwise than as specifically described herein.

What is claimed is:

1. A truing apparatus for truing a grinding wheel, comprising:

a base;

a traverse slide movable on said base in a first direction extending across said grinding wheel;

first feed means connected to said traverse slide for moving the same in said first direction;

a follow slide movable on said traverse slide in a second direction toward and away from said grinding wheel;

a follow feed mechanism contacting a template and being connected to said follow slide for moving said follow slide in said second direction to follow said template when said traverse slide is moved in said first direction;

a truing head movable on said follow slide in said second direction and provided with a truing tool for truing said grinding wheel;

second feed means connected to said truing head for moving said truing head relative to said follow slide in said second direction;

a position sensor for detecting the position of said truing head relative to said follow slide in said second direction;

a contact sensor for issuing a contact signal upon contact of said truing tool with said grinding wheel; and a truing controller connected to said first and second feed means, said position sensor and said contact sensor and including:

locating control means for operating said first and second feed means to position said truing tool selectively to first and second traverse positions spaced in said first direction and to advance said truing tool at each of said first and second traverse positions until said contact sensor issues said contact signal;

storage means for storing first and second feed positions to which said truing head is moved respectively at said first and second traverse positions until said position sensor issues said contact signal;

determination means for determining a truing start position in said second direction based on one of said first and second feed positions stored in said storage means, said one of said first and second feed positions being shorter in distance relative to said follow slide than the other of said first and second feed positions;

start position setting means for operating said first and second feed means to position said truing tool to said truing start position;

truing execution means for operating said first feed means to traverse said truing tool along said grinding surface of said grinding wheel;

ascertaining means for ascertaining whether said contact signal from said contact sensor continues while said truing tool is traversed along said grinding surface;

infeed control means for operating said second feed means to advance said truing head by an infeed amount relative to said follow slide if the discontinuation of said contact signal is ascertained by said ascertaining means; and repeate control means for repetitively operating said truing execution means and said infeed control means until it is ascertained by said ascertaining means that said contact sensor continues to issue said contact signal while said truing tool is traversed along said grinding surface.

2. A truing apparatus as set forth in claim 1, wherein said grinding wheel has first and second grinding surfaces which make an angle with each other, and wherein:

said first traverse position is defined to face said truing tool with said first grinding surface when said truing tool is positioned at said first traverse position; and said second traverse position is defined to face said truing tool with said second grinding surface when said truing tool is positioned at said second traverse position.

3. A truing apparatus as set forth in claim 2, wherein said truing head rotatably carries a truing roll as said truing tool, further comprising:

a drive motor mounted on said truing head for rotating said truing roll.

4. A truing apparatus as set forth in claim 2, wherein said contact sensor is secured to said truing head.

5. A truing apparatus as set forth in claim 1, wherein said grinding wheel is rotatably carried by a wheel head through a fluid bearing device, and wherein said contact sensor comprises:

an acoustic emission sensor secured to said wheel head for issuing said contact signal when the vibration caused by the engagement of said truing tool with said grinding wheel exceeds a predetermined level.

6. A truing apparatus for an angle grinding wheel with two grinding surfaces, of the type that a follow slide is mounted on a traverse slide, which is movable in a first direction extending across said grinding wheel, for movement in a second direction extending across the rotational axis of said grinding wheel; that a truing tool is provided on said follow slide so as to be movable by a drive device in the same direction as the moving direction of said follow slide; and that the follow slide is moved following a template as said traverse slide is moved, the improvement comprising:

a position detection device for detecting the position of said truing tool relative to said follow slide;

a vibration sensor for detecting the contact of said truing tool with said grinding wheel;

contacting means for traversing said truing tool to two positions respectively where said truing tool faces said two grinding surfaces of said grinding wheel, for bringing said follow slide into contact with said template, and for moving said truing tool by said drive device to two positions at each of which said vibration sensor issues a contact signal so as to bring said truing tool into contact with said grinding wheel;

position memory means for storing said respective positions which are detected by said position detection device when said truing tool contacts said two grinding surfaces;

position setting means for selecting from said respective positions stored in said position memory means one position which is small in the feed amount of said truing tool toward said grinding wheel and for setting an infeed position of said truing tool based on said selected one position;

truing means for advancing said follow slide to a position where said follow slide contacts said template, with said truing tool being set at said infeed position;

area setting means for setting a traverse area within which said truing tool is able to contact said grinding wheel;

judgment means for judging whether a signal above a predetermined level is obtained from said vibration sensor within said traverse area set by said area setting means;

re-truing means operable when it is judged by said judgment means that said signal above said predetermined level does not continue within said traverse area, for giving said truing tool an infeed with said follow slide having been retracted, for traversing said traverse slide to said infeed position, for subsequently bringing said follow slide into contact with said template and for traversing said traverse slide.

* * * * *